US009702079B2

(12) United States Patent
Bondi et al.

(10) Patent No.: US 9,702,079 B2
(45) Date of Patent: Jul. 11, 2017

(54) WASHING MACHINE WITH RECIRCULATION CIRCUIT

(75) Inventors: Martino Bondi, San Quirino (IT); Enrico De Michieli, Pordenone (IT)

(73) Assignee: Electrolux Home Products Corporation N.V., Brussels (BE)

( * ) Notice: Subject to any disclaimer, the term of this patent is extended or adjusted under 35 U.S.C. 154(b) by 874 days.

(21) Appl. No.: 13/298,930

(22) Filed: Nov. 17, 2011

(65) Prior Publication Data

US 2012/0125056 A1 May 24, 2012

(30) Foreign Application Priority Data

Nov. 22, 2010 (EP) ..... 10192050

(51) Int. Cl.
*D06F 39/10* (2006.01)
*D06F 39/08* (2006.01)

(52) U.S. Cl.
CPC ..... *D06F 39/083* (2013.01); *D06F 39/086* (2013.01)

(58) Field of Classification Search
CPC ..... D06F 39/083; D06F 39/086; D06F 39/10; A47L 15/4202; A47L 15/4204; A47L 15/4206; A47L 15/4208
See application file for complete search history.

(56) References Cited

U.S. PATENT DOCUMENTS 2,939,305 A 6/1960 Snyder et al.
2,962,048 A 11/1960 Steidley
2,972,877 A * 2/1961 Platt ..... D06F 13/02 68/18 F
3,305,093 A * 2/1967 Brubaker et al. ..... 210/108
3,429,444 A 2/1969 Spiegel et al.
3,466,901 A 9/1969 Reid
3,543,542 A * 12/1970 Bochan ..... 68/18 F
3,684,096 A 8/1972 Kretchman
3,977,219 A 8/1976 Bochan
4,075,876 A 2/1978 Platt
5,493,745 A * 2/1996 Hauch ..... 8/158
6,402,962 B1 6/2002 Bruntz et al.
2005/0120758 A1 6/2005 Thies et al.

FOREIGN PATENT DOCUMENTS

DE 36 02 217 7/1987
DE 10046349 A1 3/2002
DE 203 08 581 8/2003
(Continued)

OTHER PUBLICATIONS

Extended European Search Report dated Jun. 9, 2011 in corresponding European Application No. 10192050.2.
(Continued)

*Primary Examiner* — Michael Kornakov
*Assistant Examiner* — Marc Lorenzi
(74) *Attorney, Agent, or Firm* — Banner & Witcoff, Ltd.

(57) ABSTRACT

A washing machine (1) comprises a tub (2) and a draining circuit (16). The draining circuit (16) is fluidly connected to a lower portion of the tub (2). A valve (26) is arranged between the tub (2) and the draining circuit (16) and a recirculation circuit (10) is fluidly connected to the tub (2) for re-circulating fluid from a lower portion of the tub into the tub. An inlet (14) of the recirculation circuit (10) is positioned downstream of the valve (26).

19 Claims, 8 Drawing Sheets

(56) References Cited

FOREIGN PATENT DOCUMENTS

| | | | | |
|---|---|---|---|---|
| EP | 0240911 | A2 | 10/1987 | |
| EP | 0 716 178 | | 6/1996 | |
| EP | 1 204 792 | | 4/2005 | |
| EP | 1 983 094 | | 10/2008 | |
| IT | EP 1162300 | A2 * | 12/2001 | ..... D06F 39/085 |
| WO | 0297184 | A1 | 12/2002 | |

OTHER PUBLICATIONS

International Search Report mailed Dec. 29, 2011 in related International Application No. PCT/EP2011/070494.

* cited by examiner

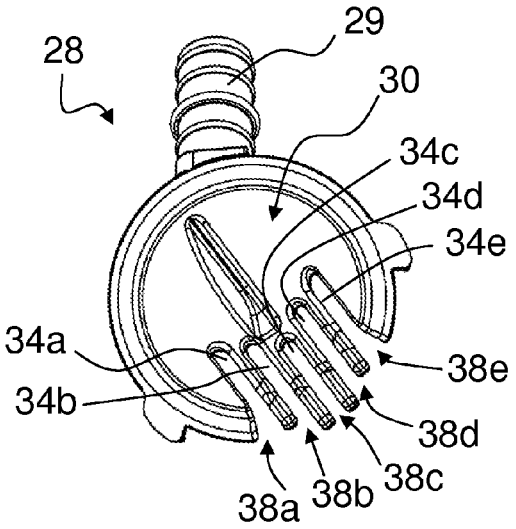
Fig. 12a
Fig. 12b
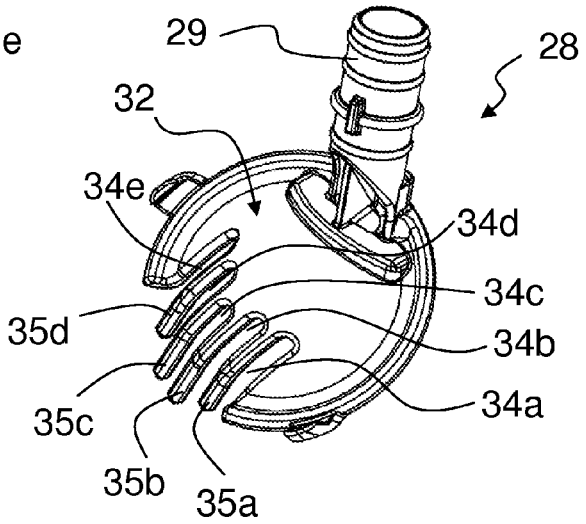
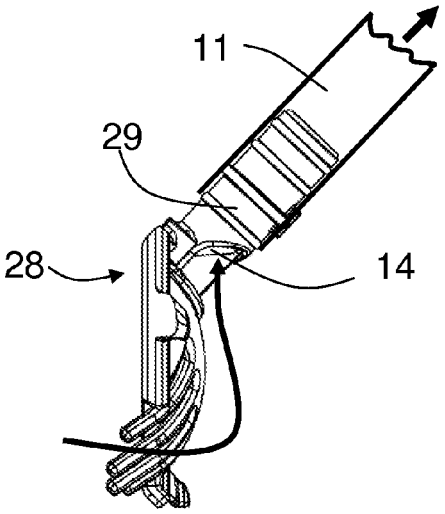
Fig. 12c
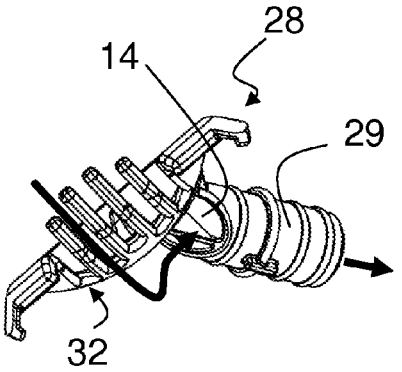
Fig. 12d

WASHING MACHINE WITH RECIRCULATION CIRCUIT

CROSS-REFERENCE TO RELATED APPLICATION

This application claims priority to European Application No. 10192050.2, filed Nov. 22, 2010.

BACKGROUND OF THE INVENTION

The invention relates to a washing machine (this expression including also a washing machine having dryer function) comprising a recirculation circuit.

EP 1 204 792 B1 discloses a washing machine having a recirculation circuit. An inlet of a draining circuit of the washing machine is connected to a sump, wherein a check valve is arranged between the sump and the inlet of the draining circuit. The check valve shuts off the sump from the draining circuit during a washing cycle. An inlet of the recirculation circuit is located at the sump and upstream the check valve.

It may occur that valves as described above are not perfectly watertight during a washing operation. The valve may partially be opened due to variations of pressure inside the tub and/or of movements of the tub or drum. In particular at the beginning of a washing cycle, when a detergent like a powder detergent is not fully dissolved in the washing water, this detergent can accumulate at a lower portion of the tub due to gravity. Such undissolved detergent can enter the draining circuit through a partially opened valve with the risk of reducing the washing effect and/or of obstructing the draining pump.

SUMMARY OF SELECTED INVENTIVE ASPECTS

It is an object of the invention to provide a washing machine which allows an improved and economic washing operation.

In the following, when reference is made to "water", the term "water" may denote water as such, washing water, washing liquid, washing liquor or the like. When reference is made to "washing machine", the term "washing machine" can denote a front-loading type or a top-loading type washing machine, both having or not also a dryer function.

According to an aspect of the invention, a washing machine comprises a tub and a draining circuit fluidly connected to the tub to drain water from the tub. The draining circuit may be connected or attached to the tub or the tub may comprise a sump and the draining circuit may be attached or connected to the sump. A valve is arranged between the tub and the draining circuit. The valve is adapted to shut off or seal the tub from the draining circuit, advantageously in particular during a heating phase of a washing cycle of the washing machine. Due to the closed valve, water within the draining circuit is not heated, whereby the energy consumption of the washing machine is reduced. The washing machine comprises a recirculation circuit, which is fluidly connected to the tub to circulate fluid from a lower portion of the tub to an upper or middle portion of the tub. Without a recirculation circuit and to thoroughly wet laundry within the drum, it is necessary to supply a sufficient amount of water into the tub, such that the laundry is covered with the water. By recirculating the washing water, the amount of water required for wetting the laundry is reduced, as the washing water is repeatedly sprayed onto or supplied to the laundry in the drum. Consequently, the amount of water to be heated is reduced, wherein the energy consumption of the washing machine is further reduced. An inlet of the recirculation circuit is positioned downstream the valve. In other words, the inlet of the recirculation circuit is positioned, with respect to the flow of water which exits the tub through the valve and goes to the draining circuit, after the valve (i.e. the water exiting the tub meets the inlet of the recirculation circuit after passing the valve).

For example, the inlet of the recirculation circuit may be positioned below a valve seat (which will be better described in the following). Advantageously, when the valve is in the closed position to shut off the tub from the draining circuit, the inlet of the recirculation circuit is positioned or arranged to be fluidly connected to the draining circuit, preferably close to the valve. Thus, the draining circuit is fluidly disconnected from the tub when the valve is closed.

In case undissolved detergent has passed the valve (e.g. during the water filling process when detergent is flushed into the tub) due to a not perfectly watertight sealing of the valve, this detergent collects in the draining circuit substantially below the valve seat around the valve opening in the tub. At the next time when the recirculation circuit is operated, the detergent collected in this way below the valve seat will be sucked in through the inlet of the recirculation circuit below (or downstream seen from the tub) the valve, and is recirculated back into the tub. Thereby the washing effect is enhanced as detergent is more efficiently used instead of being drained from the washing machine like for example in EP 1 204 792 B1. In other words, less detergent gets lost in the draining circuit of the washing machine and therefore less detergent is necessary to achieve the same washing result. Thus, the washing machine provides an economical washing operation with respect to energy and detergent consumption.

The detergent collected downstream of the valve can be sucked in and recirculated by the recirculation circuit (i.e. when operating the recirculation pump) for example by operating the recirculation circuit temporally before heating the washing water (during heating the washing water the recirculation pump is stopped). Alternatively or additionally the detergent collected downstream the valve is sucked in and recirculated by the recirculation circuit after heating the water, preferably during a washing period that is following a heating period of the washing cycle.

In case the draining circuit is directly attached to the tub via the valve body, i.e. no sump is provided, the inlet of the recirculation circuit may be arranged at or connected to a portion of the draining circuit downstream (e.g. below) the valve. Alternatively a sump is provided at a lower portion of the tub, wherein the draining circuit is attached to the sump. Then the inlet may be connected to the sump of the washing machine below the valve. In particular, a sump can be formed by a recess at a lower portion of the tub or by a portion of the draining circuit below the tub.

Preferably, the valve comprises a valve body containing a movable closure element adapted for closing or opening the valve; in an advantageous embodiment the movable closure element has a valve seat and a movable closure element adapted to be releasably engaged with the valve seat for closing the opening through the valve seat. Preferably, the valve is automatically closed or opened in dependency on a water level in the draining circuit and/or tub. In other words the valve is adapted to be self-actuated in dependency on a water level, in particular by a closure element which is floating in or on the water. E.g., the closure element floats on the water that fills the draining circuit or a sump and is eventually pressed towards the valve seat by the rising water level, i.e. by buoyant force, and seals thereby a valve opening in the valve seat. Thereby, the tub is shut off from the draining circuit, wherein a simple and robust valve is provided which is maintenance-free or is substantially maintenance-free.

Preferably, the movable closure element has a spherical or substantially spherical shape, such that it may engage with the valve seat in any (rotated) position. This is advantageous when the closure element is freely floating within the sump or draining circuit. Alternatively, the closure element may be formed by a hinged flap, e.g. like in a swing check valve, which is closed by buoyant force and water pressure.

Other kind of valves (e.g. electrically controlled) may be used for allowing or impeding water to flow from the tub to the draining circuit.

In an advantageous embodiment the valve body is formed by the sump container or a portion thereof, or by a portion of a draining suction duct connecting the tub to a draining pump. Thus, the number of elements for providing the valve is reduced as compared to a valve having a separate body. In case the inlet of the recirculation circuit is arranged at a bottom or lower region of the valve body, the recirculation circuit has an improved ability to suck in undissolved detergent that has collected at the lower region of the valve body (e.g. sump or draining suction duct) due to gravity.

Preferably, a lug advantageously protruding from the valve body facilitates mounting of a suction duct of the recirculation circuit to the valve body. Alternatively or additionally the valve body may have further ports for fluid connection, for example an opening in fluid connection to a duct which itself is connected for example to a pressure sensor for detecting the water level in the tub. Thus, the valve body acts as a manifold for fluidly connecting a plurality of elements and functional components of the washing machine.

Advantageously, the washing machine according to the invention comprises a filter element adapted to prevent foreign objects, e.g. lint, from entering the recirculation circuit. Thereby, a clogging of the recirculation circuit or of a recirculation pump is prevented.

The filter element is preferably arranged in proximity to or in correspondence with the inlet of the recirculation circuit.

In a preferred embodiment, the filter element extends or protrudes at least partially or with a main section thereof into the inner space of the valve body. Preferably, but not necessarily, in such an arrangement the filter element may act as a support for the movable closure element, wherein the filter element is designed such that in case of a low water level and when the closure element is no longer buoyant on the water or is pressed down by flowing water, the closure element does not cover the bottom region of the valve body or covers only a portion thereof. Thus, undissolved detergent collected on the bottom region of the valve body can be sucked in by operating the recirculation circuit. Sucking in undissolved detergent is further improved when there is a gap at least over a portion area between the lower surface of the filter element and the upper surface of a bottom region of the filter element. Additionally, this gap assists in washing away deposits and fluff from the filter element and the recirculation circuit when the drain circuit is operated and water is drained out of the washing machine.

Preferably, the filter element is cleanable by fluid drained from the tub during at least one draining phase of a washing cycle. That means the filter element is automatically cleaned, i.e. fluff and foreign objects are washed off the filter element, during each draining phase of a washing cycle by water/washing water flowing past the filter element.

According to a preferred embodiment, at least one filter aperture of the filter element extends to a lateral border of the filter element to let fluid pass. I.e., the at least one filter aperture comprises an interrupted circumference and/or an opening like a gap in its circumference. Preferably, the at least a portion of the filter apertures is formed as spacings between filter fingers or tines forming filter or rake pins. During recirculating of the washing water through the recirculation circuit, fluff and other foreign objects, which may exit the tub through an opened or partially opened valve, are caught in the filter element. During a draining phase of the washing machine or of a washing cycle thereof, the gap in the circumference of the aperture facilitates washing away foreign objects which are caught in the at least one aperture. The self-cleaning of the filter element is further supported by letting the gap face in the drain flow direction, i.e. in a discharge direction of the draining circuit. Thereby, the fluff, etc. caught in the at least one aperture is washed away or moves during a draining phase in a direction of the gap from where it is easily washed out of the at least one aperture into the drain circuit. Preferably, the filter fingers or rake pins having a free-standing end are aligned parallel to or partially extending into a flow direction of a water flow from the tub to the draining pump when the draining pump is operating.

According to a preferred embodiment, the at least one aperture comprises shape which is tapered from the gap to a base of the at least one aperture opposite to the gap. I.e., the base of the aperture which lies opposite to the gap is narrower than the gap. Due to the narrowing of the aperture, the trapping of fluff and foreign objects in the aperture is facilitated and in turn due to the widening of the aperture from the base to the gap, the removal or washing away of fluff or foreign objects which are caught in the aperture is facilitated. For example, the at least one filter aperture comprises a shape selected from rectangular, substantially rectangular, triangular, substantially triangular, semicircular or substantially semicircular.

Preferably, but not necessarily, the opening or gap takes up at least 1/16, 1/10, 1/5 or 1/4 of the circumference of the at least one filter aperture. Thereby the gap is sufficiently large to allow, e.g., fluff, to be readily washed away from the filter element.

Preferably, the filter element comprises at least two filter apertures, preferably at least five filter apertures or eight filter apertures. In particular, the apertures are arranged parallel or substantially parallel to each other, such that the apertures form a filter element having fingers or teeth like a fork or rake.

According to a preferred embodiment, the filter element comprises, in at least one cross-section plane, an arched or bent cross-section or is concave in the drain flow direction or as seen from the tub side. E.g., the filter element has a bowl-like shape such that the catching of fluff is further facilitated.

Preferably, a surface of the filter element facing the valve is shaped to receive the movable closure element of the valve on or at the surface. Preferably the filter element receives the closure element on its surface when water is drained from the tub or when the water is circulated through the recirculation circuit, i.e. when the valve is open. Due to the draining flow a (mainly rotational) movement of the closure element on or above the filter element may create a vortex which helps removing fluff or other foreign objects from the filter element.

According to a preferred embodiment the filter element is attached to, in or at the inlet, the draining circuit and/or the sump of the washing machine in a cantilevered manner. E.g., only a portion of the periphery of the filter element is fixed or attached, such that the filter element is self supporting. E.g., a free end of the filter element extends into the draining circuit and/or the sump of the washing machine. In other words, the filter element does not extend across the entire cross-section of the drain circuit or sump of the washing machine. Due to the free end of the filter element, washing the fluff off the filter element towards and into the draining circuit or sump is further facilitated.

According to a preferred embodiment, a first portion of the filter element attached to or at the inlet of the recirculation circuit, the draining circuit and/or sump comprises a closed surface, and a second portion of the filter element extending into the draining circuit, tub and/or sump comprises the at least one filter aperture and/or fingers. Thereby, the filter element comprises a fork-like or rake-like shape with the gap(s) or fingers extending into the drain flow during a draining phase. Thereby, the cleaning of the filter element is facilitated.

According to an advantageous method of using a washing machine according to the invention, during the heating of the water in the tub the valve is closed so that the water in the sump area (sump container and/or draining duct to the draining pump) and the recirculation circuit is not heated. Heat energy is thus effectively restricted to the tub interior for washing purposes. For transporting undissolved detergent that has collected in the sump area downstream a valve seat of the valve, into the tub, the draining circuit is operated before starting the heating phase and/or after the heating phase. Thus, detergent is brought back into the tub for full or nearly full recovery of undissolved detergent.

Relating to the described and illustrated embodiments of the washing machine, each isolated feature of an embodiment can be added to another embodiment, or any arbitrary combination of isolated or individual features from an embodiment can be added to another embodiment.

BRIEF DESCRIPTION OF THE DRAWINGS

Reference is made in detail to a preferred embodiment of the invention, an example of which is illustrated in the accompanying figures.

FIGS. 12*a-d* are perspective views of a filter element as shown in FIGS. 9*a-d*.

DETAILED DESCRIPTION OF EXAMPLE EMBODIMENTS

Figure 1:
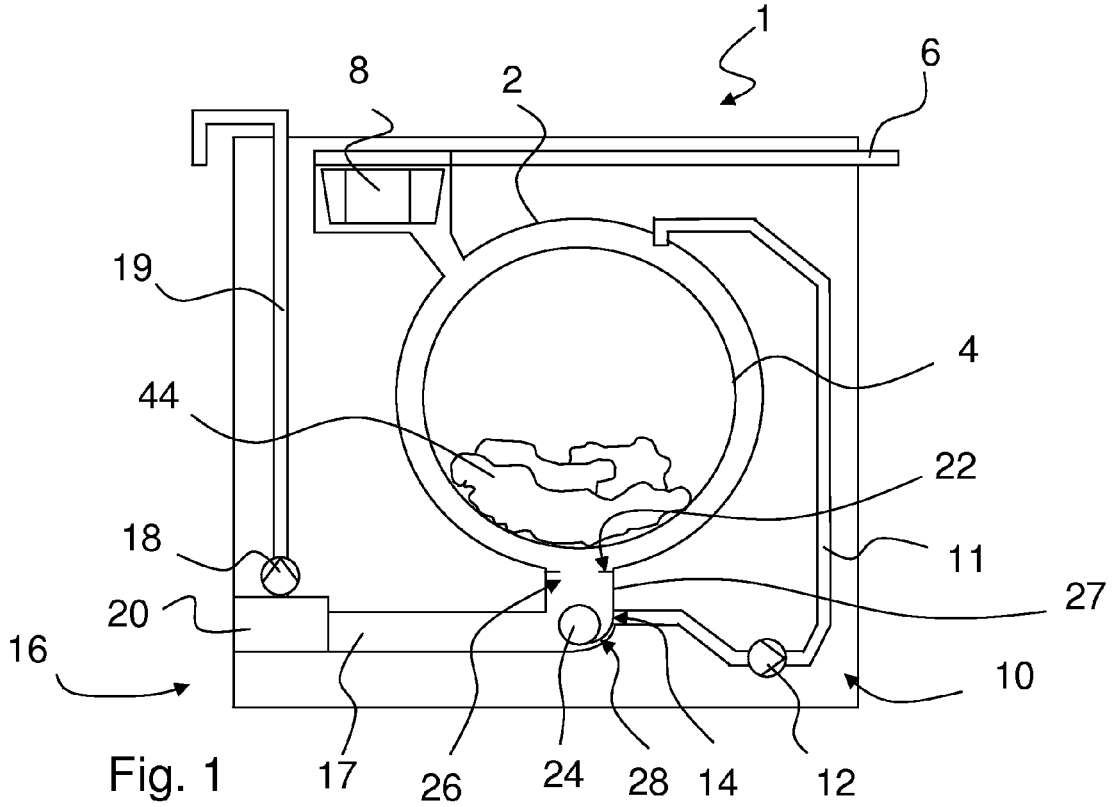
FIG. 1 is a schematic cross-sectional front view of a washing machine according to the invention.

FIG. 1 depicts a schematic cross-sectional front view of a washing machine 1 comprising a tub 2 with a drum 4 rotatably arranged therein. A draining circuit 16 preferably comprises a draining pump 18, a draining suction pipe 17, a draining riser pipe 19 and a draining filter 20. The draining suction pipe 17 is fluidly connected to the tub 2 to drain water, washing water or fluid from the tub 2 during a draining phase when the draining pump 18 is operated. A valve 26, preferably, but not necessarily, comprising a valve body 27 and a valve seat 22, advantageously in form of a diaphragm with an opening, is arranged between the tub 2 and the draining circuit 16. Advantageously, a movable closure element 24, for example a ball, which is freely movable or floatable in the valve body 27, is adapted to engage with the valve seat 22 to shut the tub 2 from the draining circuit 16. The movable closure element 24 is advantageously made of floatable material e.g. plastic, so that it can float on the water depending on the water level in the draining suction pipe 17/valve body 27. When the water level rises, the movable closure element 24 is raised towards the valve seat 22 until the movable closure element (e.g. the ball) closes the opening at the valve seat 22. The valve seat may be formed in a diaphragm or plate as shown in FIG. 1. In the depicted embodiment, the draining suction pipe 17 is pipe-shaped and forms (at least part of) the sump, and the valve body 27 is connected to the lowest point of the tub 2. However in other embodiments the draining suction pipe 17 may have different shapes, at least in the region directly below the opening to the tub.

In a heating phase of a washing cycle, the water in the tub 2 is heated by a heating element (not shown) arranged in the tub. When the valve 26 is closed, only the water in the tub 2 is heated, not the water in the draining circuit 16, whereby the energy consumption of the washing machine is reduced.

A recirculation circuit 10 is provided to circulate water or washing water from a lower portion of the tub 2 to an upper portion of the tub 2 (as in the embodiment shown), or to a middle portion of the tub. The recirculation circuit 10 preferably comprises a suction pipe 13 fluidly connected to the draining suction pipe 17 (forming the sump), a recirculation pump 12 and a recirculation pipe 11. When the recirculation pump 12 is operated, the laundry 44 in the tub 2 is efficiently wetted without having to provide an amount of water in the tub 2 which completely (or even partially) covers the laundry 44. I.e., on the one hand the water consumption during a washing cycle is reduced and on the other hand, due to reduced water consumption less water has to be heated, whereby the energy consumption is reduced.

The recirculation pump 12 and the draining pump 18 are not watertight. Thus, the water level in the recirculation pipe 11 and the draining riser pipe 19 corresponds to the water level in the tub 2 or draining suction pipe 17 when the pumps 12 and 18 are not operated and the valve 26 is open.

A filter element 28 is arranged downstream of the valve seat 22 in front of an inlet 14 of suction pipe 13 of the recirculation circuit 10. When the recirculation pump 12 is operated, the water passes the filter element 28 before it enters the recirculation circuit 10. The filter element 28 prevents fluff and foreign objects which may pass through the opened or partially opened valve 26 from entering the recirculation circuit 10, where they might obstruct a nozzle at the outlet of the recirculation pipe 11 or the recirculation pump 12. When no water is in the draining circuit 16, the recirculation pump 12 is operated or the water level is low, the movable closure element 24 rests on the bottom of the valve body 27 and/or on the filter element 28.

Figure 2:
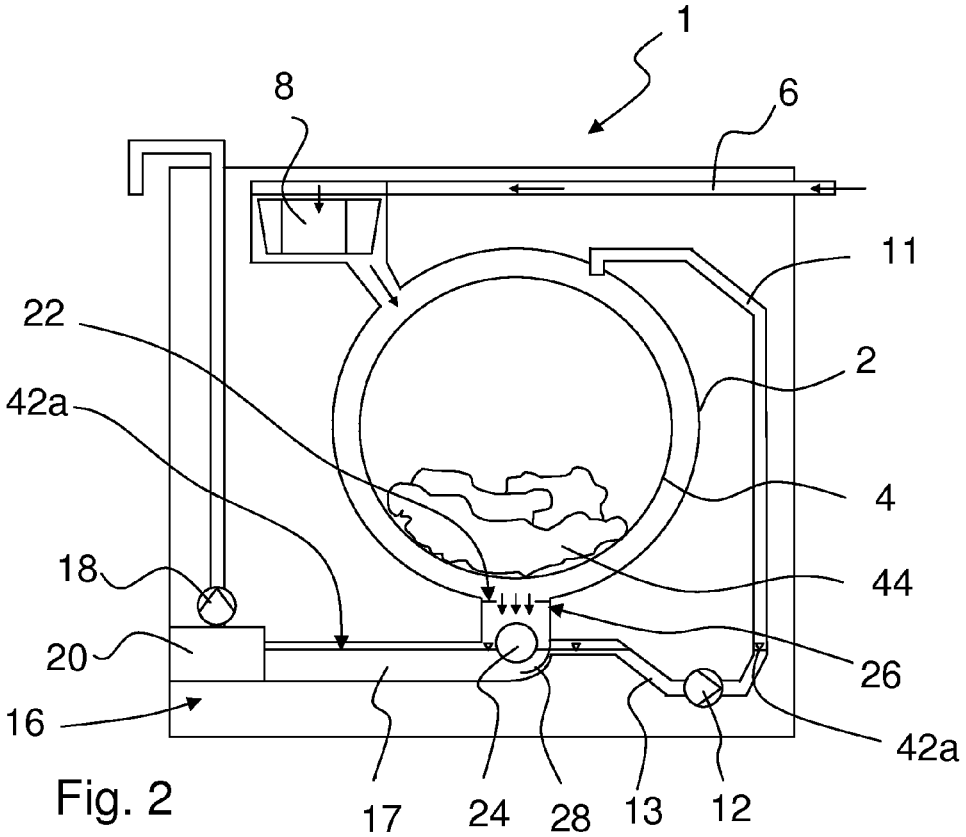
FIG. 2 is a schematic cross-sectional front view of the washing machine of FIG. 1 during filling of water into a tub thereof.

FIG. 2 depicts a schematic cross-sectional front view of the washing machine of FIG. 1 at the beginning of a washing cycle. As depicted by arrows, tap water flows into the tub 2 via a water inlet 6. The tap water flows through a detergent drawer 8, from where it carries detergent into the tub 2 and drum 4 as indicated with the arrows. In this state the water level 42*a* is in a range where the movable closure element 24 is not abutting the valve seat 22 such that the valve 26 is open. Thus the water fills the draining circuit 16 and partially the recirculation circuit 10.

Figure 3:
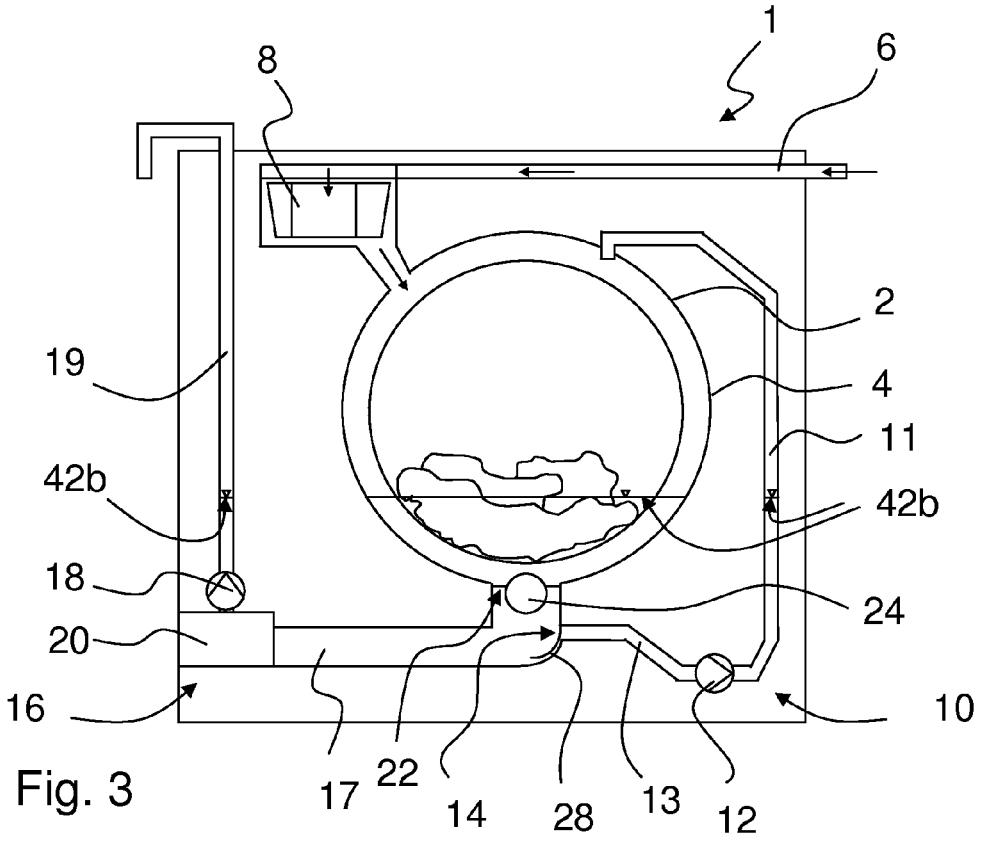
FIG. 3 is a schematic cross-sectional view of the washing machine of FIG. 1, wherein the tub is partially filled with water.

FIG. 3 depicts a schematic cross-sectional view of the washing machine of FIG. 1 during a phase of the washing cycle when the tub 2 is filled with water up to the maximum water level 42*b* for the selected washing program. In this phase the draining pump 16 and the recirculation pump 12 are not activated. The washing water has reached maximum level 42*b* which partially covers the laundry 44 in the tub 2. While the water level was rising from level 42*a* to 42*b* and due to the hydrostatic buoyant force, the movable closure element 24 is pushed or pressed against the valve seat 22 and closes the valve 26 thereby. The valve 26 provides a simple and robust way for automatically shutting off the tub 2 from the draining circuit 16 during those phases of the washing cycle, in which the pumps 12, 18 are not operated and in which the water level has a minimum height to press the movable closure element 24 against the valve seat 22. In particular the valve 26 is preferably closed during a heating phase when the water is filled to close the valve and when no pumps are operated.

Figure 4:
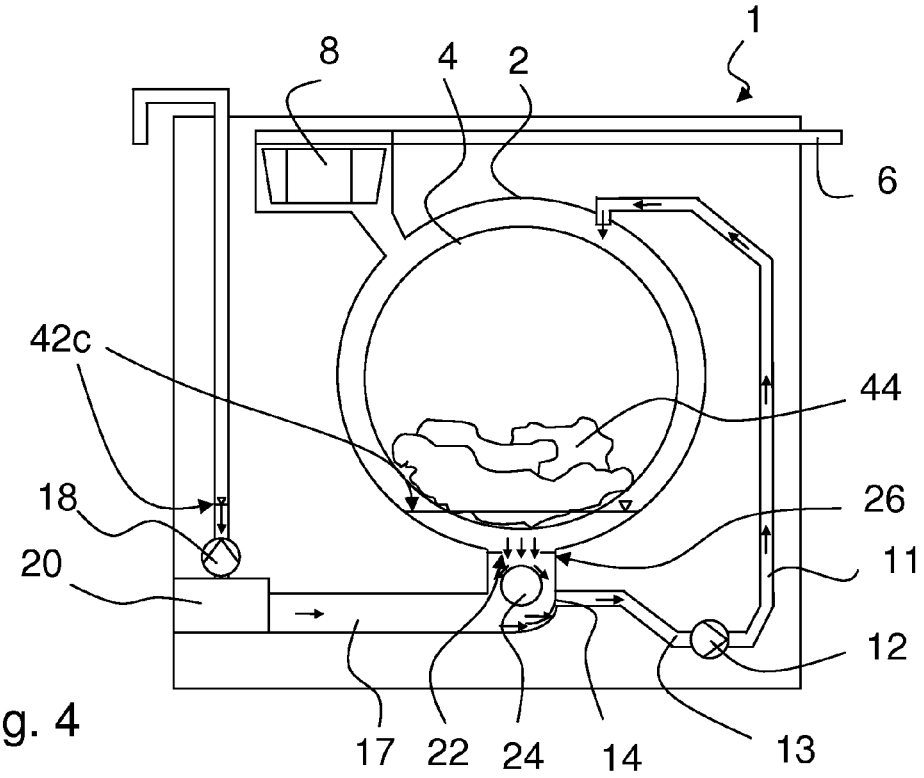
FIG. 4 is a schematic cross-sectional front view of the washing machine of FIG. 1 during a recirculation phase.
Figure 6:
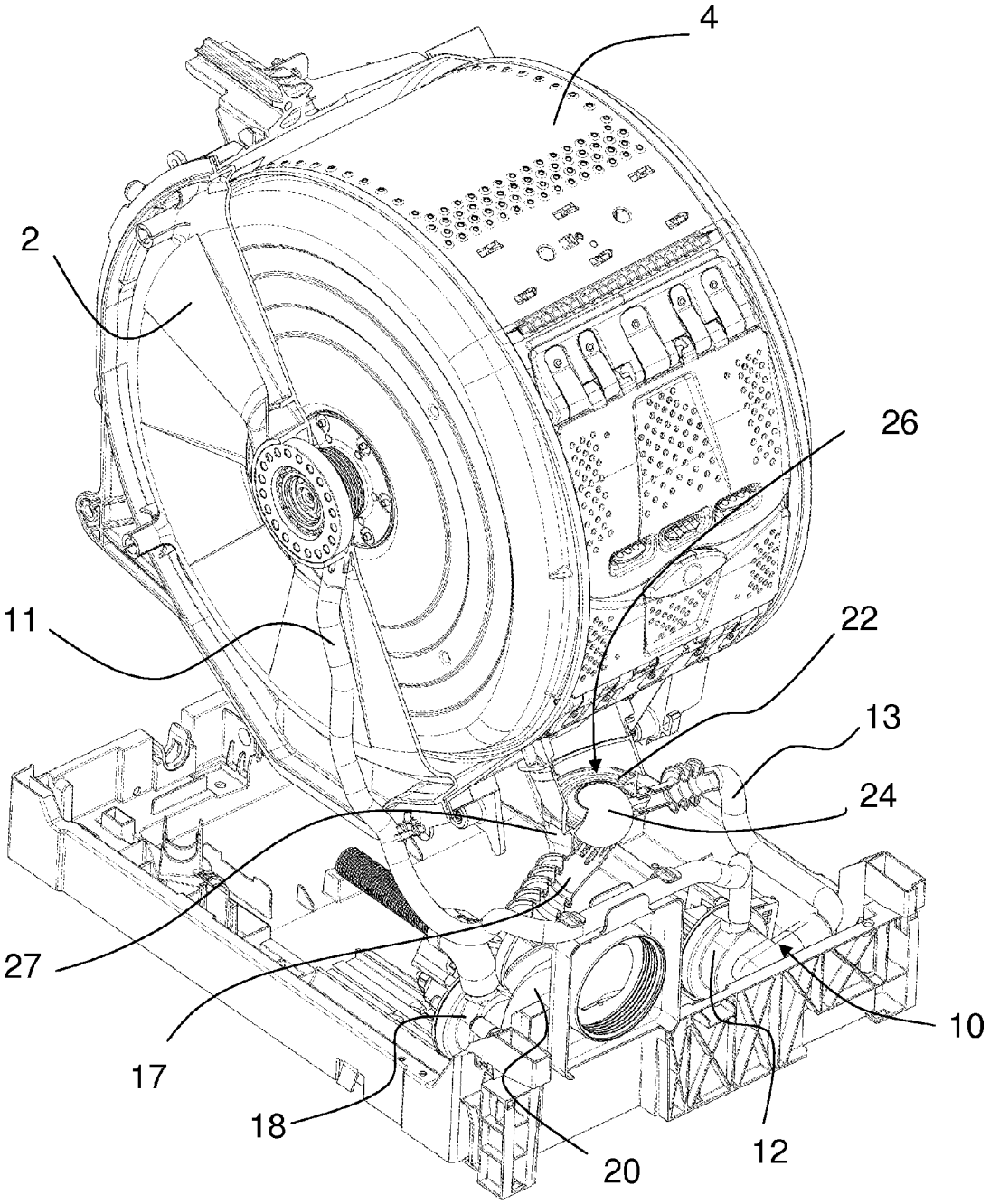
FIG. 6 is a perspective, partially cross-sectional side view of a part of an exemplary internal structure of a washing machine.

FIG. 4 depicts a schematic cross-sectional front view of the washing machine 1 of FIG. 1 during a recirculation phase of a washing cycle. The recirculation pump 12 is activated and pumps the washing water from the sump or the draining suction pipe 17 to the outlet of the recirculation pipe 11 (which may have a nozzle) which is connected to the interior of the tub 2. While operating the recirculation circuit 10, recirculation pipe 11 is filled with water and the water level drops from maximum level 42*b* to an intermediate washing level 42*c*. As shown in the embodiment of FIG. 4, the recirculation circuit feeds the water into the tub 2 and onto the drum 4. The drum 4 comprises holes or perforations through which the washing water enters the drum 4 and wets the laundry 44. Alternatively, the recirculation circuit 10 feeds the water directly into the drum 4 through an outlet at a rotational axis of the drum 4 (FIG. 6). In another embodiment (not shown), the outlet of pipe 11 or a nozzle is arranged at a loading door of front-loader washing machine such that the recirculated water can be sprayed or sprinkled through the loading opening of the drum directly into the drum and the laundry 44 therein.

It may happen that detergent, in particular powder detergent, is not completely dissolved at the beginning of a washing cycle. For example, at the beginning of flushing in the detergent by flowing tap water through the detergent drawer 8 and before the water level is high enough to close the valve 26 (see e.g. water level 42*a*), some detergent may remain undissolved and can be flushed along the tub inner wall through the opening in the seat 22 into the sump or draining suction pipe 17. There it may collect due to gravity. Additionally, even if the water level is high enough to close the valve 26, undissolved detergent collecting at the lowest point of the tub 2 may enter the draining circuit if valve 26 does not perfectly close the opening in the seat 22, e.g., during drum rotation operation of the washing machine.

As indicated by FIG. 4, the activated recirculation pump 12 creates a suction force on its suction side which opens or partially opens the valve 26 due to the pressure difference acting on the movable closure element from above and below, and the movable closure element's buoyant force. The movable closure element 24 is moved away from its seat 22. Thereby water can be pumped from the tub 2 although the inlet 14 of the recirculation circuit 10 is placed downstream the valve seat 22. I.e., the valve 26 is automatically opened during a recirculation phase of a washing cycle by the suction force of the recirculation pump 12. Referring to the collection of detergent in the sump or the draining suction pipe 17 described before, as the inlet 14 of the recirculation circuit 10 is placed below or downstream of the valve seat 22, any detergent deposited or collected in the sump or pipe 17 is recirculated back into the tub 2 when operating the recirculation circuit, whereby the detergent is effectively and efficiently used for the washing cycle.

Figure 5:
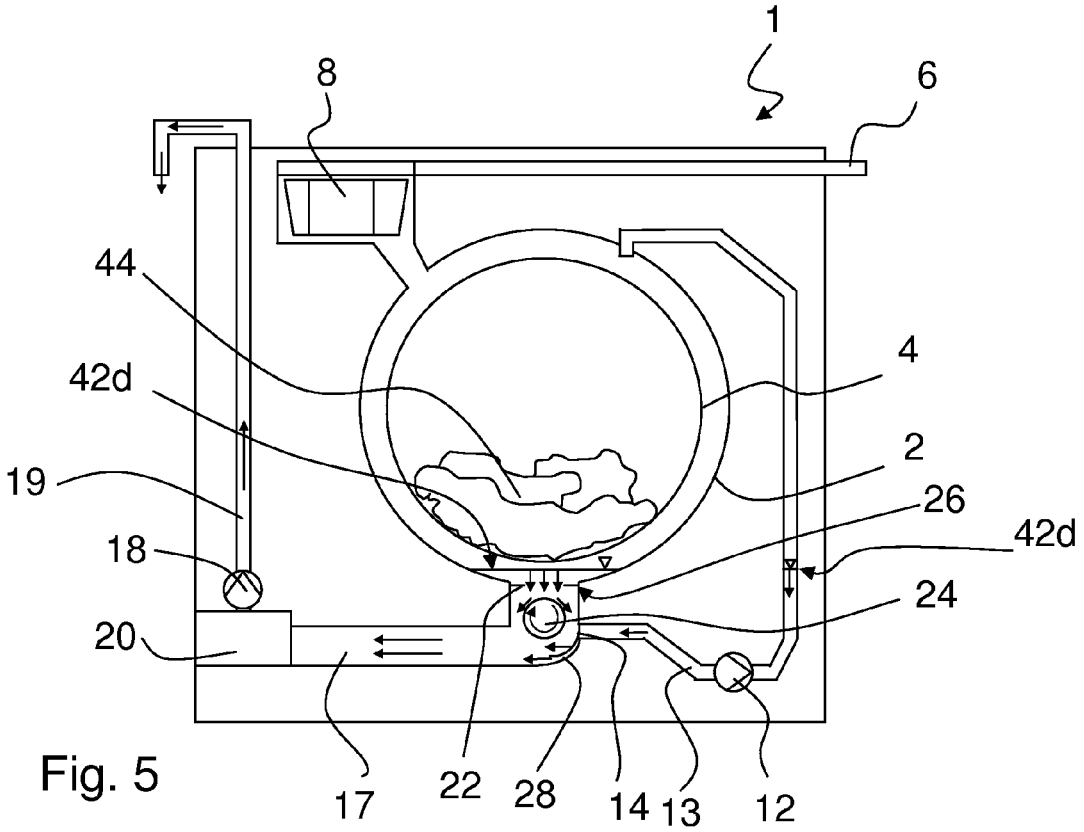
FIG. 5 is a schematic cross-sectional front view of the washing machine of FIG. 1 during a draining phase.

FIG. 5 depicts a schematic cross sectional front view of the washing machine 1 of FIG. 1 during a draining phase of a washing cycle. The flow of the washing water is depicted with arrows. The suction force of the draining pump 18 on its suction side opens the valve 26 and the draining pump 18 pumps water from the tub 2 and also from the recirculation circuit 10 through the draining riser pipe 19 and out of the washing machine 1. The washing water exiting the tub 2 and flowing past the filter element 28 cleans the filter element 28, i.e. washes or flushes the filter element 28. Preferably the filter element 28 is arranged in the draining flow, draining circuit 16 or valve body, such that the water flowing from the tub 2 in a draining phase hits the filter element 28 at an acute angle with respect to the surface 30 of the filer element 28. Thereby fluff and foreign objects caught by the filter element 28 are washed away from the filter element 28 during the draining of water. In other words, the filter element 28 forms a deflector element which deflects or redirects the draining flow from the tub 2 to the draining circuit 16, in particular to the draining suction pipe 17. Further, in the flow or current of the washing water out of the tub 2, the movable closure element 24, in particular if it is ball shaped, moves mainly in a rotational movement (arrow). This movement of the movable closure element 24 creates a vortex which assists in removing fluff and foreign objects from the filter element 28. In other words a "self-cleaning" filter element 28 is provided. Additionally, the backflow of water from the recirculation circuit 10 and out of the recirculation pipe 11 (as indicated by the falling water level 42*d*) assists in washing any caught foreign objects away from the filter element 28. Foreign objects which are washed from the filter element 28 or out of the tub 2 are subsequently caught in the draining filter 20, which is accessible from the outside for a user for cleaning. This is particularly advantageous if the filter element 28 itself is not accessible for a user from outside the washing machine.

FIG. 6 depicts a perspective, partially cross-sectional side view of a part of an exemplary internal structure of a washing machine 1 as schematically depicted in FIG. 1, which in this embodiment is a top-loading washing machine. The same reference signs are used for the same features of the washing machine 1 as described above. Relating to technical details and functional operation, full reference is made to the above embodiment schematically shown. The drum 4 is rotationally supported in the tub 2. Below the tub 2 the valve 26 is shown in a partial cross-sectional view. The movable closure element 24 (in this case ball-shaped) is engaged in the valve seat 22 and shuts the tub 2 from the draining circuit 16 in the state as depicted. The inlet 14 of the recirculation circuit 10 is located below the valve 26, in particular below the valve seat 22. The suction side of the recirculation pump 12 is connected via suction pipe 13 to the sump or draining suction pipe 17. The output side of the pump 12 is advantageously connected via recirculation pipe 11 to a passage through and having an outlet preferably at a rotational axis of the drum 4. The draining circuit 16 is fluidly connected to the tub 2 through the opening in the valve seat 22 (having the form of a diaphragm or plate) such that washing water can be drained from the tub 2 through pipe 17, draining filter 20, pump 18 and draining riser pipe 19 to the outside of the machine with the draining pump 18 operating.

Figure 8:
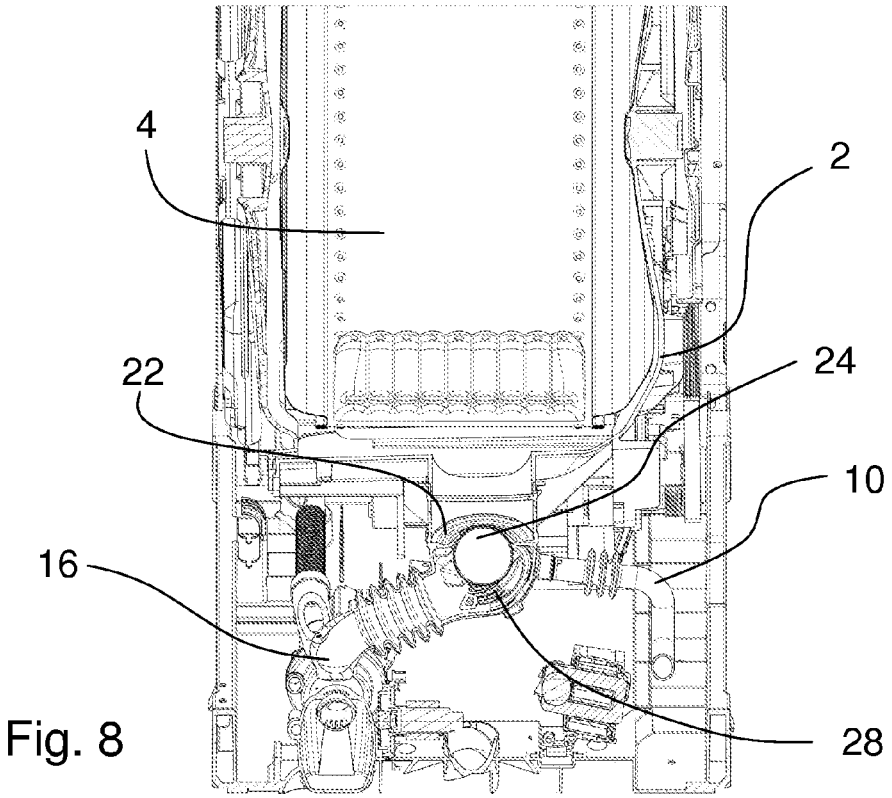
FIG. 8 is a partial cross-sectional view of a detail of the structure of the washing machine shown in FIG. 6.
Figure 7:
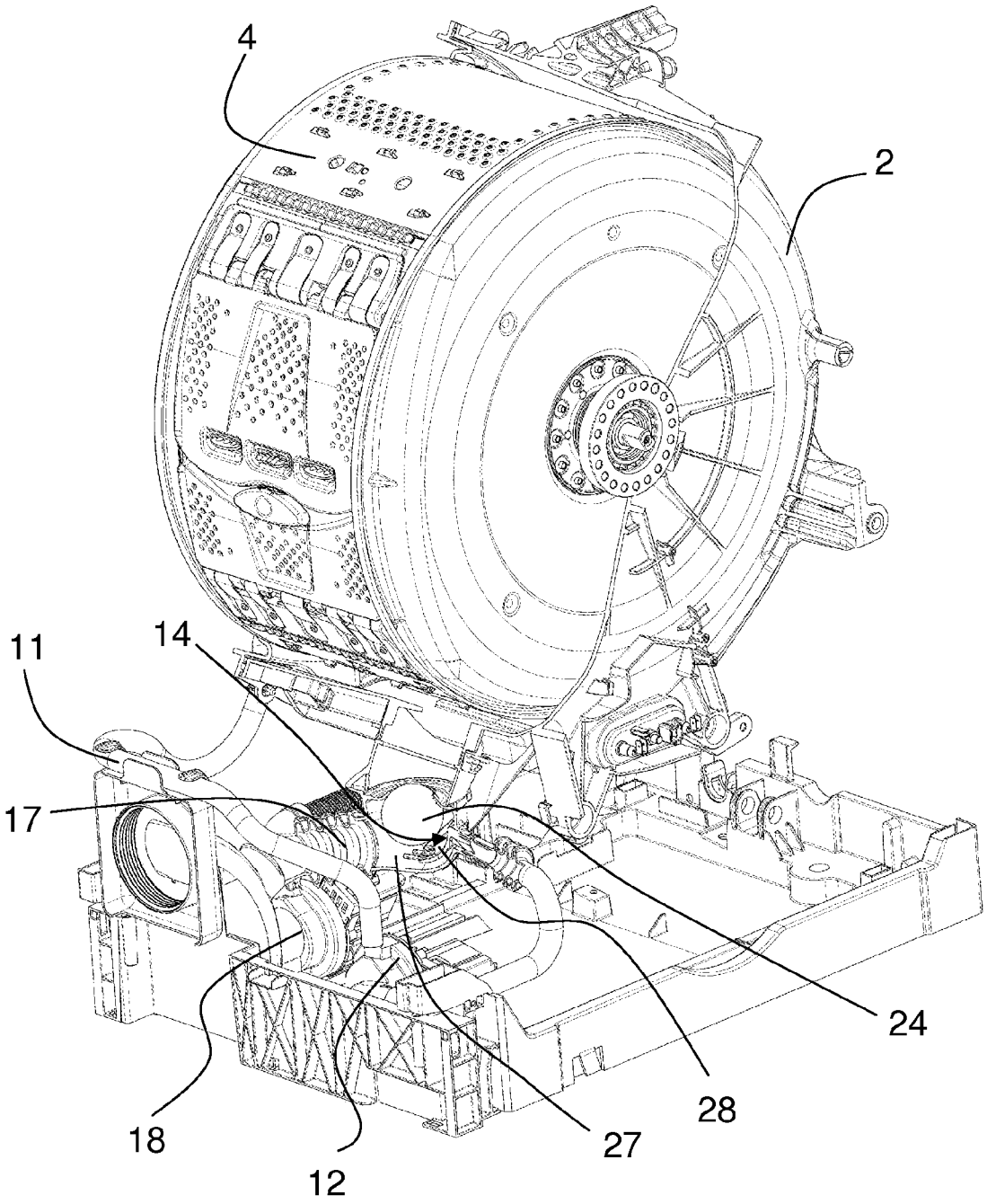
FIG. 7 is a perspective, partially cross-sectional side view of the internal structure of the washing machine shown in FIG. 6.

FIG. 7 shows a perspective, partially cross-sectional side view of the structure of FIG. 6. In this partial cross-sectional view, the filter element 28 can be seen, which is arranged at the inlet 14 of the recirculation circuit 10. FIG. 8 shows a partial cross-sectional view of a detail of the structure of FIG. 6. The diaphragm or plate of the valve seat 22 is attached at the lower rim of an extension of the tub 2, extending at the bottom of the tub. The valve body 27 receiving the movable closure element 24 is preferably attached to the tub extension at the diaphragm and is forming part of the draining section pipe. Advantageously, both the suction pipe 13 and the draining suction pipe 17 have sections formed as a bellows. The bellows serve for damping vibrations of the tub from being transferred to the pumps 12, 18.

Figure 9A:
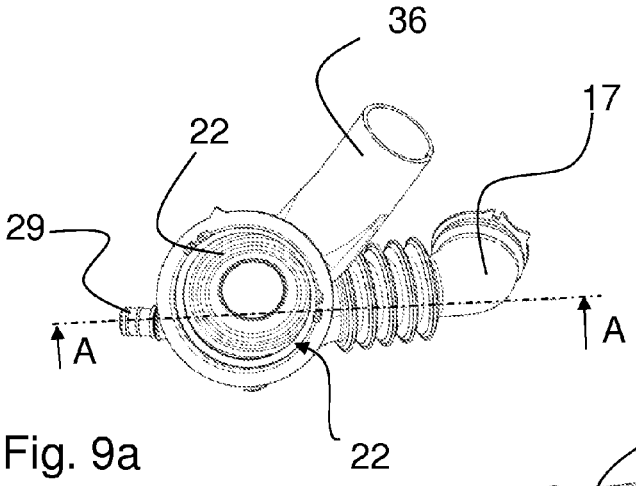
FIGS. 9*a-d* are perspective views and cross-sectional views of a valve as shown in FIG. 6.

FIGS. 9*a-d* depict perspective, cross sectional views of the valve 26 as shown in FIG. 6. FIG. 9*a* shows a top view of the valve 26, wherein the diaphragm forming the valve seat 22 is shown from the tub side. A lug 29 is attached to and protruding from the valve body 27 which is used to attach one end of the suction pipe 13. The filter element 28 is attached to the lug 29; preferably the filter element 28 is made as a single or monolithic part with the lug. The lug 29 is used to mount the filter element 28 at an outlet in the valve body 27, wherein the outlet forms the inlet 14 to the suction circuit 10.

Preferably, a further opening 37 in the valve body 27 fluidly connects the interior of the valve body 27 to a duct 36 depicted in FIG. 9*a-d*. The duct is preferably connected to a pressure control (pressostat, not shown) for detecting the water level 42 in the tub 2.

Figure 9B:
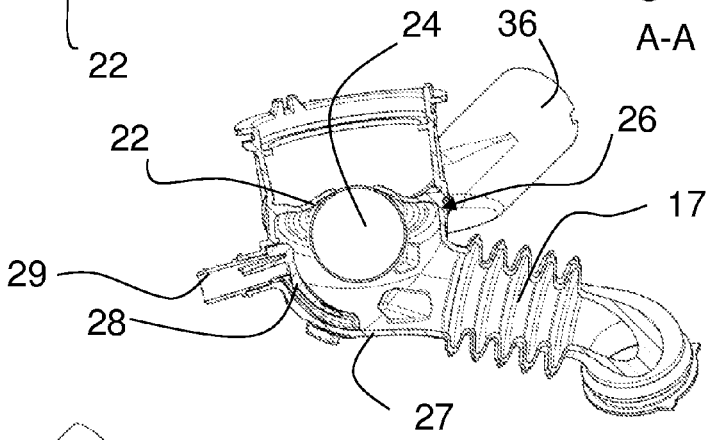

FIG. 9*b* shows a cross sectional view of the valve 26 along line A-A of FIG. 9*a*. The valve 26 is shut or closed by movable closure element 24 which rests in its seat 22 and blocks thereby the opening in the valve 26. The filter element 28 is attached to the inlet 14 of the recirculation circuit 10 by the mounting portion or lug 29 which is connected to the recirculation circuit by a plug connection. In particular the filter element 28 is attached to the lug 29 forming the inlet 14 in a cantilevered manner, such that the main body of the filter element 28 extends into inner volume of the valve body 27 in a free-standing manner. A portion of the filter element 28 facing the inner space of the valve body 27 preferably comprises a bent shape which corresponds or basically corresponds to the shape of the movable closure element 24.

Figure 9C:
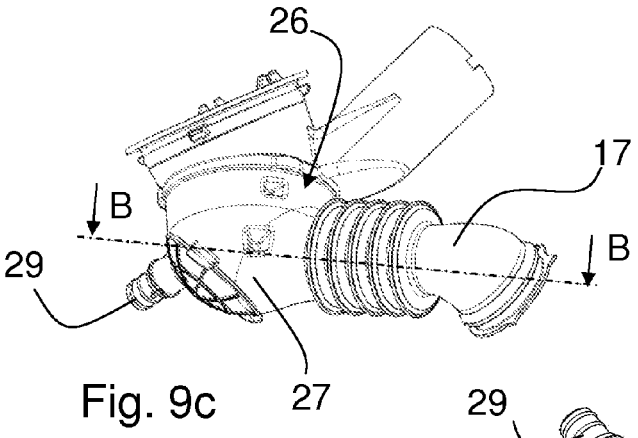
Figure 9D:
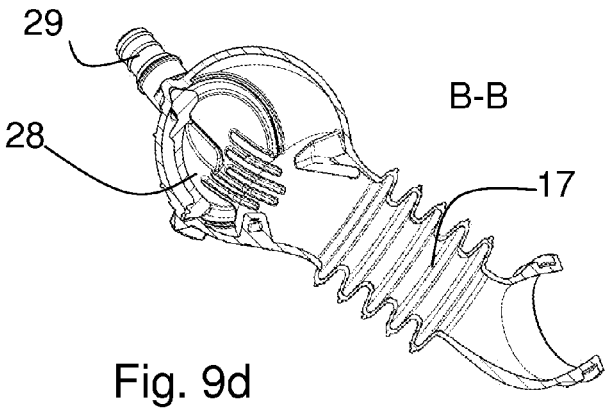

FIG. 9*d* shows a cross sectional view from below along the line B-B shown in FIG. 9*c*. In this embodiment the filter element 28 has advantageously a fork-like shape and comprises fingers 35*a-d* with apertures 34*a-e* between the fingers having open entrances 38*a-e* (or gaps) to the fingers. Advantageously, the fingers of the filter form the teeth or pins of a rake. The fingers 35*a-d* are preferably parallel or essentially parallel to a flow path of water flowing from the tub through the valve body 27 to the draining pump 18 in draining phases.

Figure 10:
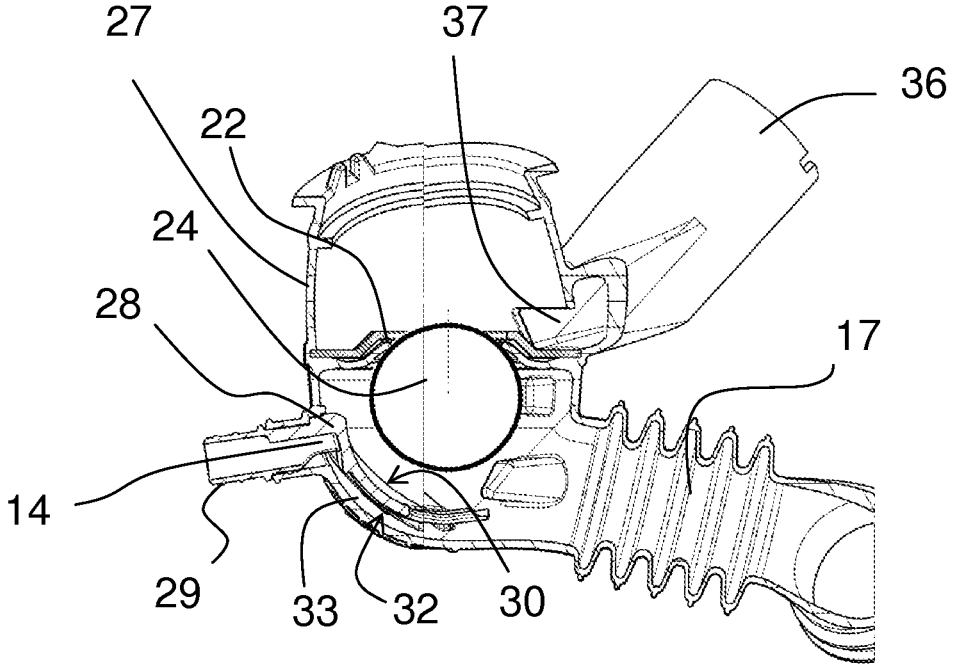
FIG. 10 is a cross-sectional side view of the valve of FIGS. 9*a-d* in a closed state.

FIG. 10 shows a cross-sectional side view of the valve of FIGS. 9*a-d* in a closed state, which has been described with respect to FIG. 3. Due to the water filling the tub 2, the draining circuit 16 and partially the recirculation circuit 10, the resulting buoyant force on the floatable movable closure element 24 presses the latter against the valve seat 22 (both pumps 12, 18 are not operating).

Figure 11:
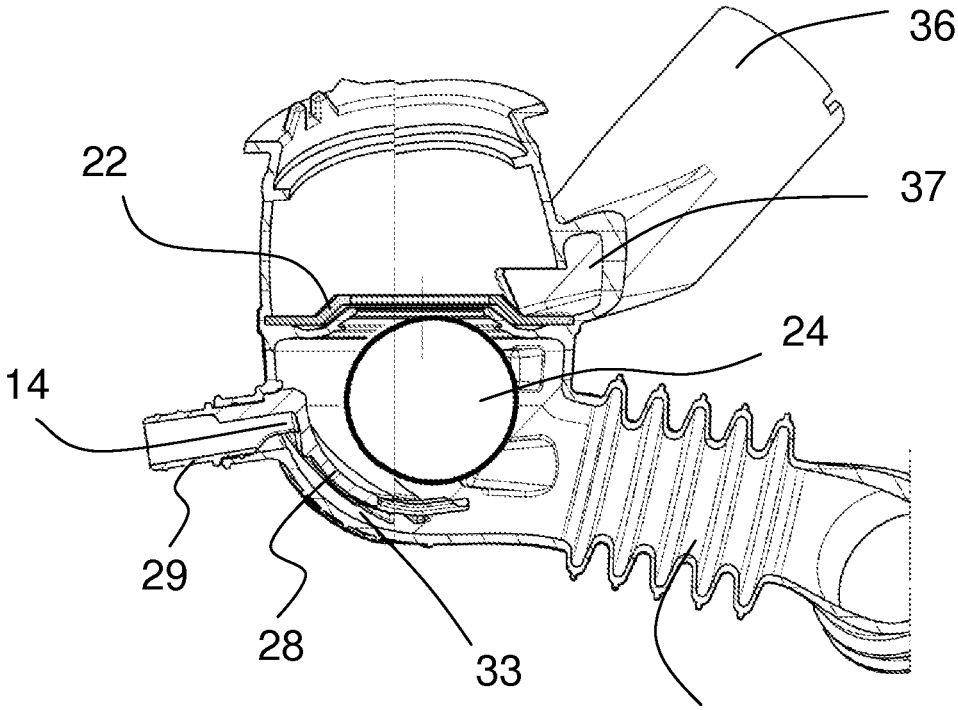
FIG. 11 is a cross-sectional side view of the valve of FIG. 9*a-d* in an opened state.

FIG. 11 shows a cross-sectional side view of the valve of FIGS. 9*a-d* in an opened state, which has been described with respect to FIGS. 2, 4 and 5. Due to a low water level 42*a* (FIG. 2) or due to the suction force of the recirculation pump 12 (FIG. 4) or suction force of the draining pump 18 (FIG. 5) the valve 26 is opened. The movable closure element 24 is advantageously in close proximity to the filter element 28 or supported by the filter element, which comprises a curved shape which matches or substantially matches the shape of the movable closure element 24. A rotational movement of the movable closure element 24 due to the water flow during a draining phase assists the removal of e.g. fluff from the filter element 28 as described above.

FIGS. 12*a-d* show perspective views of the filter element 28 as shown in FIG. 6. FIG. 12*a* shows the filter element 28 from above, i.e. the upper surface 30 of the filter element which faces the interior of valve body 27. The filter element 28 advantageously comprises a plurality of apertures 34*a-e*, which extend to a lateral border of the filter element 28 such that each aperture 34*a-e* has a laterally open side.

FIG. 12*b* shows the filter element 28 from below, i.e. it shows the surface 32 of the filter element 28 which faces away from the movable closure element 24 or valve 26. As described above, the filter element is advantageously part of the lug 29 which forms at the same time a mounting portion for mounting the filter element 28 in the opening of the valve body 27. Thereby the filter element 28 is supported on one side in a cantilevered manner and the main body of the filter element 28 projects into the inner space of the valve body 27. The outer surface of the filter element 28 faces a portion of the inner surface of the valve body 27 and the filter element 28 is preferably arranged such that there is a gap 33 between the outer or lower surface 32 of the filter element and the inner surface of the valve body.

FIG. 12*c* shows a side view of the filter element 28, wherein an arrow depicts the flow of water during a recirculation phase of a washing cycle. FIG. 12*c* also shows attachment of the recirculation pipe 11 on the lug 29. The water passes through the apertures 34*a-e* of the filter element from the upper side 30 to the lower side 32 of the filter element 28 and enters the recirculation circuit 10, in particular through an opening in the mounting portion 29.

The arrows in FIGS. 12*c* and 12*d* indicate the water flow during a recirculation phase. Fluff or foreign bodies are retained at the fingers or teeth of the filter 28 and are washed along the fingers to a base of the fingers opposite to the aperture openings 34*a-e* where the fluff and foreign bodies collect. In contrast thereto, during a draining phase of a washing cycle the washing water flows past the filter element 28 from above coming through the aperture in the valve seat 22 and also some water flows in reverse direction out of the circulation circuit 10. This water flow washes the fluff and foreign bodies in direction from the base of the fingers towards the aperture entrances 38*a-e*. Thereby any fluff or objects caught in the filter element 28 are easily washed out and are not permanently caught in the filter element 28 (i.e. in the filter apertures 34*a-e* or the fingers of the filter). Further, preferably a portion of the filter element 28 in proximity to the recirculation circuit 10 has a closed surface. In other words the apertures 34*a-e* preferably do not extend across the entire surface of the part of the filter element 28 which extends into the draining circuit 16. The closed portion of the filter element 28 may catch larger foreign objects without the risk that these objects obstruct the apertures 34*a-e* of the filter element 28. Further, the closed portion of the filter element 28 assists the above described deflection of the drain water flow and assists thereby in efficiently cleaning the filter element 28.

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. A washing machine comprising:

a tub;

a draining circuit, wherein the draining circuit is fluidly connected to a lower portion of the tub;

a valve arranged between the tub and the draining circuit, said valve comprising a valve body containing a movable closure element adapted to close or open the valve based on a water level due to buoyancy of the movable closure element, wherein the draining circuit is fluidly disconnected from the lower portion of the tub when the closure element closes the valve;

a recirculation circuit fluidly connected to the tub for re-circulating fluid from the lower portion of the tub into the tub, wherein:

an inlet of the recirculation circuit is positioned downstream of said valve and arranged at a bottom and/or a lower portion of the valve body;

said washing machine comprises a filter element for preventing foreign objects from entering the recirculation circuit;

wherein the inlet of the recirculation circuit is arranged behind the filter element and said filter element is attached at the inlet of the recirculation circuit;

said filter element comprises at least one aperture formed between fingers or rake pins;

said filter element extends or protrudes at least partially into an inner space of said valve body; and said filter element is arranged in such a way as to act as a support for said movable closure element, and is configured such that in case of a low water level and said closure element is no longer buoyant on the water, said closure element does not cover a bottom region of said valve body or covers only a portion thereof; and a pump arranged to generate a flow of water through said valve body, wherein when said pump is not in operation and with a water level in said valve body greater than said low water level, said movable closure element is configured to rise due to buoyancy to close said valve and fluidly disconnect the draining circuit from the lower portion of the tub.

2. The washing machine according to claim 1, wherein said valve is closed and opened in dependency on a water level and/or a pressure difference between the tub and a body of said valve.

3. The washing machine according to claim 1, wherein the movable closure element has a spherical shape.

4. The washing machine according to claim 1, wherein the valve body comprises a sump container, or a portion of a sump container and/or a portion of a draining duct.

5. The washing machine according to claim 2, wherein said pump comprises a recirculation pump in said recirculation circuit, and operation of said recirculation pump can generate said pressure difference causing said valve to open.

6. The washing machine according to claim 5, further comprising a draining pump separate from the recirculation pump, the draining pump in said draining circuit, and operation of said draining pump can generate said pressure difference causing said valve to open.

7. The washing machine according to claim 1, wherein the valve comprises a valve seat, and wherein the movable closure element is configured to releasably engage with the valve seat when the movable closure element rises due to buoyancy to close the valve.

8. The washing machine according to claim 1, wherein the valve body comprises a sump container in the lower portion of the tub.

9. The washing machine according to claim 1, wherein the valve body comprises a lug having a passage forming said inlet, for connecting the recirculation circuit to the valve body.

10. The washing machine according to claim 1, wherein the valve body comprises an opening fluidly connecting an inner volume of the valve body and/or an inner volume of the tub to a pressure sensor.

11. The washing machine according to claim 1, wherein a main body of the filter element is cantilever mounted to extend into an interior of the valve body as a free-standing element.

12. The washing machine according to claim 1, wherein a gap is formed between the filter element and an inner surface of a body of said valve.

13. The washing machine according to claim 1, wherein the filter element is connected to or integrally formed with a lug serving to mount the filter element at an outlet of the valve body.

14. The washing machine according to claim 6, wherein the fingers or rake pins have a free-standing end aligned parallel to or partially extending into a flow direction of a water flow from the tub to the draining pump when the draining pump is operating.

15. The washing machine according to claim 1, wherein the filter element comprises at least two filter apertures.

16. The washing machine according to claim 15, wherein the apertures are arranged parallel to each other.

17. The washing machine according to claim 1, wherein the filter element comprises at least five filter apertures.

18. The washing machine according to claim 1, wherein the filter element comprises at least eight filter apertures.

19. The washing machine according to claim 15 wherein the apertures are shaped like a fork or a rake.

* * * * *